US006998984B1

(12) United States Patent
Zittrain et al.

(10) Patent No.: US 6,998,984 B1
(45) Date of Patent: Feb. 14, 2006

(54) STATE ADAPTATION DEVICES AND METHODS FOR WIRELESS COMMUNICATIONS

(76) Inventors: Jonathan Zittrain, 112 Banks St., Cambridge, MA (US) 02138; Shermann Loyall Min, 77 Paloma Ave. #203, Pacifica, CA (US) 94044; Zachary Mainen, 1 Bungtown Rd., Cold Spring Harbor, NY (US) 11724; Mary Wilson Lambert, 130 Barrow St., Apt. 307, New York, NY (US) 10014; David Goetsch, 1829 Courtney Ave., Los Angelos, CA (US) 90046

( * ) Notice: Subject to any disclaimer, the term of this patent is extended or adjusted under 35 U.S.C. 154(b) by 619 days.

(21) Appl. No.: 09/912,264

(22) Filed: Jul. 24, 2001

(51) Int. Cl.
*G08B 23/00* (2006.01)

(52) U.S. Cl. ..... 340/573.1; 340/7.6; 340/539.11; 340/815.65

(58) Field of Classification Search ..... 340/573.1, 340/573.4, 539.11, 539.12, 539.13, 407.1, 340/815.4, 815.65, 7.2, 7.6, 7.61
See application file for complete search history.

(56) References Cited

U.S. PATENT DOCUMENTS 4,121,160 A * 10/1978 Cataldo ..... 340/539.11
4,491,970 A * 1/1985 LaWhite et al. ..... 455/100
4,611,198 A * 9/1986 Levinson et al. ..... 340/539.11
4,637,732 A 1/1987 Jones et al. ..... 368/109
4,675,656 A * 6/1987 Narcisse ..... 340/573.4
4,713,808 A 12/1987 Gaskill et al. ..... 370/94
4,864,276 A 9/1989 Tribbey et al. ..... 340/407
5,007,105 A 4/1991 Kudos et al. ..... 455/344
5,181,009 A 1/1993 Persona ..... 340/407
5,321,229 A 6/1994 Holling et al. ..... 219/448
5,353,017 A 10/1994 Suzuki et al. ..... 340/825.46
5,416,695 A 5/1995 Stuntman et al. ..... 364/413.02
5,438,309 A 8/1995 Krumme ..... 337/140
5,463,514 A 10/1995 Yeager ..... 360/105
5,494,113 A 2/1996 Poland ..... 169/37
5,544,784 A 8/1996 Malaspina ..... 221/135
5,554,971 A 9/1996 Foster et al. ..... 340/825.46
5,565,840 A 10/1996 Thorner et al. ..... 340/407.1

* cited by examiner

*Primary Examiner*—Thomas Mullen
(74) *Attorney, Agent, or Firm*—Wilmer Cutler Pickering Hale and Dorr LLP

(57) ABSTRACT

A communications system has first and second units whereby, when a user changes the physical state of the first unit, a message is sent to the second unit to cause the second unit to change to the same state. This change in state can be, for example, a physical squeezing movement or a change in color.

35 Claims, 3 Drawing Sheets

STATE ADAPTATION DEVICES AND METHODS FOR WIRELESS COMMUNICATIONS

BACKGROUND OF THE INVENTION

The present invention relates to wireless communications between people. There are a number of ways for people to stay in touch by using wireless communications. Over short distances, people can use walkie-talkies to communicate, and over longer distances, cellular telephones, or the use of a telephone to a pager. Each of these cases generally involves one person sending a written or audio message to the other person using a dedicated communications device. In the case of a cell phone, pager, or walkie-talkie, the person with the device carries the device in his or her pocket or in some form of holster.

These methods generally rely on sound to gain attention. Some pagers, however, include mechanical vibrators so that a person may know that a message is arriving by the vibration. When the vibration occurs, the recipient then looks to the pager for the message. A variation of such a pager are dedicated, limited purpose pagers provided in restaurants for patrons waiting for tables; such pagers may only vibrate (or beep) because the message to the patron that he or she should see the host for a table is understood.

SUMMARY OF THE INVENTION

The present invention utilizes a process referred to here as "state adaptation," by which a group of two or more devices use wireless networks to adopt a closely related or common changed state. A person with one device can make a change to that person's device, thereby causing a change in other devices in the group. Groups of two or more devices thus affect, and are affected by, one or more of the other devices in the group, regardless of separation distance. This state adaptation is preferably accomplished over a wireless communications network, or for devices for use at short distances, through direct radio contact.

State adaptation can be accomplished by an electronic and mechanical system. A sensor determines a state, such as a mechanical state, of a device, and a transmitter communicates this information to the other devices in the group using embedded wireless communication hardware either periodically, or by sending a message when there is a change. This information is received by a receiver in each device, decoded, then used by the receiving device to update its own state appropriately.

The state that is monitored, communicated, and replicated may be mechanical. In one embodiment, a bracelet system includes a mated pair (or some greater number) of bracelets, preferably designed to look more like jewelry than like communications devices. If the holder of a bracelet makes a physical change by squeezing the bracelet mechanically, the contraction is detected by an embedded switch and is transmitted to the other bracelets in the group. Those wearing the other mated bracelets will feel a squeeze from their respective bracelets. The result of the bracelets adapting to the same state is a subtle, intimate, and non-intrusive means of communication that can be both non-textual and inaudible. The device can be standalone, or part of a watchband or some other worn device.

In another embodiment that is at least partially mechanical, a bracelet or watch has a face that can have one of several colors and a mechanism for triggering a change in the color, such as turnable bezel. The state of the device is the color of the face; and turning the bezel changes that color. This change in color is, in turn, communicated to the other devices in the group which respond by changing color on the faces of their devices accordingly.

The state can thus be a persistent change, like changing the color until changed, or a temporary physical change, like a one-time squeeze.

The change that is made, including a squeeze or color change, is not audible and non-textual, unlike telephones or pagers, and thus does not require an audible alert or that the user read a message.

The devices are "mated," meaning that the devices are matched in advance such that a signal from one is automatically sent to the other mated device, in contrast, for example, to a cell-phone or pager that requires a user to enter a specific number or identification, or to a walkie-talkie in which all such devices can pick up a signal from one device in the area.

Such state adaptation may be either one-way or two-way. In a one-way configuration, one device is the master. Manipulation of the master affects the state of all the other devices, but not vice-versa. In a two-way configuration, each device in the group affects the state of all other devices in the group.

States can be passed between two devices by encoding the states using a protocol determined by a wireless network providing the service. Two-way state adaptation requires a two-way service, such as two-way messaging or cellular telephony. One-way state adaptation may be implemented using a traditional paging technology. For applications which do not require operation at great distances, direct transmission and reception may be used.

State adaptation requires very little data to be sent between units. Consequently, the energy requirements of a unit are small, this factor is important for minimizing size and extending battery life. Moreover, the network load supporting these units is low because the air time per message is minimized. This low load contrasts with the current trend in mobile communications toward high bandwidth applications. It is easy to use state adaptation to send signals over long distances between two people. Thus, while this system is not a personal communications system, it can be used as such. As a notification system, the bracelets offer both discreteness and timely acknowledgement of a predetermined message between the two parties, such as "I've arrived at the station. Come pick me up." Others may see that this bracelet offers a more tangible means of connectedness in which a squeeze conveys the idea, such as "I'm thinking of you."

In all cases, information may be attached to the state of a device. As such, these devices may indeed be considered communication devices. But unlike cellular phones and pagers, state adaptation devices do not define the information being exchanged. Rather, the users are given the flexibility to make this definition. This allows for a wide variety of uses not currently done. For example, a succession of squeezes of the bracelet may be defined by the users to represent a type of language encoding much like Morse code, allowing the users to freely communicate with each other. In other words, depending upon the users, state adaptation devices may exchange more than just a predetermined message.

Other features and advantages will become apparent from the following detailed description, drawings, and claims.

DETAILED DESCRIPTION

Figure 1:
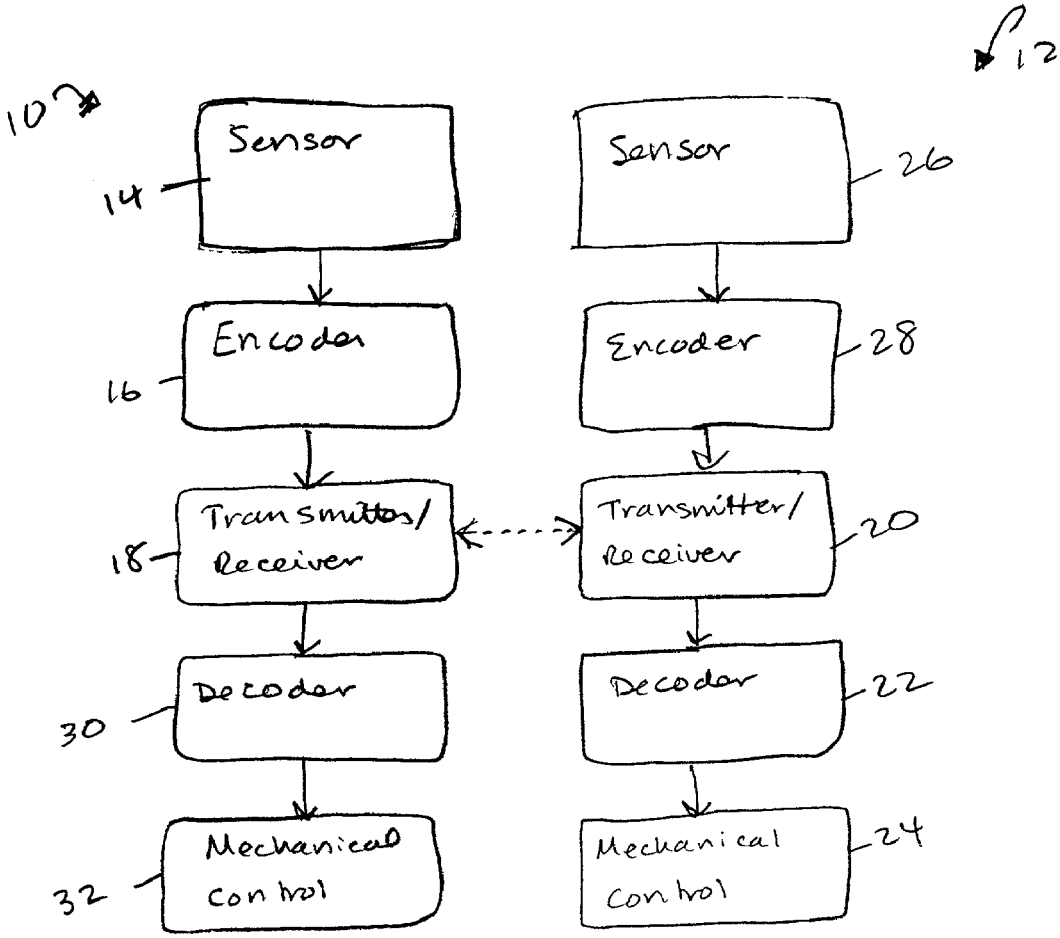
FIG. 1 is a block diagram of a pair of devices according to the present invention.

FIG. 1 illustrates basic components of communicating devices according to the present invention. The devices are referred to here as "bracelets", which are useful embodiments of the present invention, with the understanding that other devices could be used or that the functionality of these devices could be incorporated in another wearable or easily portable device, such as a watch. The bracelets may be comparable with a typical wrist watch in size and weight, and preferably appear low-tech or even plain, unlike devices such as walkie-talkies. The devices may be styled as simple bracelets with no visible writing, display screens, or buttons when worn, and with no user-accessible on/off switch.

Figure 2:
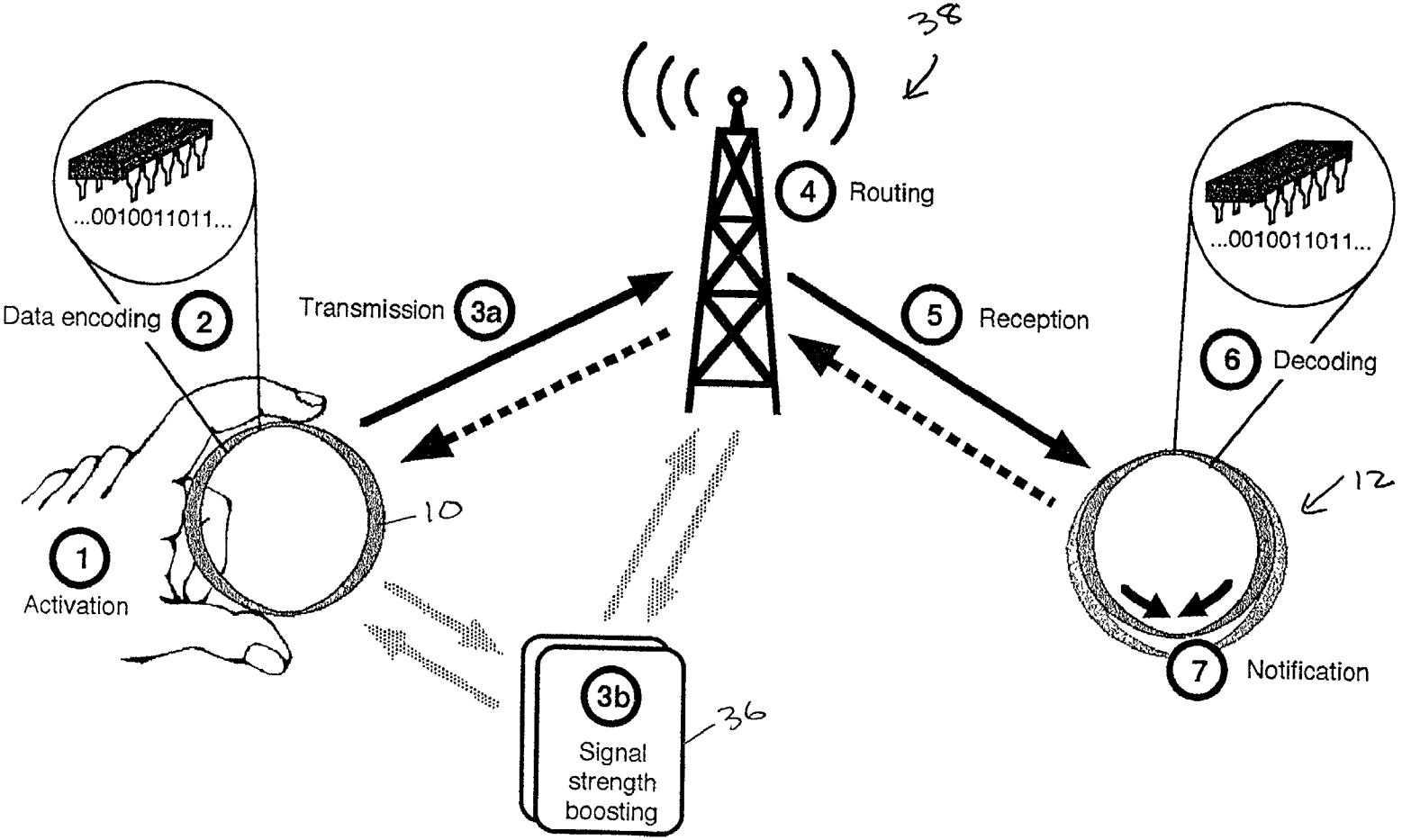
FIG. 2 is a pictonal diagram showing one embodiment of the present invention.

Referring also to FIG. 2, in one embodiment of the present invention, bracelets 10 and 12 are normally in "standby mode" and thus are ready to initiate or respond to a change in mechanical state. This change may be a squeeze as described here, or some other change as discussed below. A user of a bracelet squeezes bracelet 10, thus mechanically engaging a switch 14. A single button can be used as the switch, but to prevent inadvertent activation, it is preferable that an array of switches be used, thus requiring the user to squeeze a significant portion or the entire bracelet. The sensor may alternatively include a fluid displacement switch, which works by responding to a total volume compression of a fluid contained in a flexible membrane encircling the bracelet. Activating the bracelet thus requires nothing more than a gentle squeeze of the unit itself. A click will be felt by the user as confirmation that a squeeze was initiated. Similarly, the recipient will feel this squeeze as a gentle but distinct contraction of the bracelet itself or other physical means, such as a light tap.

Bracelet 10 has an encoder 16 for encoding signals relating to squeezes and other information into digital data form for transmission. Squeezes may be transmitted either directly (one-for-one) or by queuing a number of squeezes into a buffer and converting them into a data string which contains the number and timing of squeezes. This conversion may be accomplished with an internal clock and logic circuit to encode the timing of squeezes into a few bytes of digital data. This latter method reduces communications load, thereby avoiding delays associated with transmitting closely-spaced squeezes. This data string is then combined with other information required by the applicable communications protocol (e.g., unit identification number, recipient ID number, error bits, and data length) to become a data packet for transmission.

The encoded data packet is provided to a transmitter/receiver 18 for transmission to and reception by transmitter/receiver 20 of bracelet 12 without providing a specific code or designation to identify the recipient. The devices are mated such that only the mated device or devices receive the signal, even if there are a number of types of devices in the vicinity that are not so mated. This transmission can be provided by conventional, digital, radio frequency communication technology, such as that used in paging, cellular, PCS, or satellite communications networks.

The transmission signal strength may be boosted by separating bracelet functionality into the bracelet itself worn on the wrist (or elsewhere) and a booster pack which is carried in a pocket or purse. The transmitter would thus have ultra-low power for sending and receiving signals to and from booster pack 36, which then performs the higher-power transmission to the network. This method relaxes the design constraints of an integrated wearable device by removing the main battery and associated hardware from the bracelet, where size, weight, and cost are of paramount concern.

The receiving station for network 38 performs the routing functions necessary to pass the data packet from the sending unit to bracelet 12, as is done by cellular telephone, two-way paging, PCS or satellite communications networks. Each bracelet unit may be assigned to a particular set of one or more reciprocal units. Specification of the receiving unit can be accomplished in different ways, such as, by storing the association on board each unit, or by storing a complete table of unit-to-unit associations in a central routing computer. With the former approach, an identification number of the recipient is part of the data packet transmitted by sending bracelet 10 to network 38 and may be routed directly by the receiving station. With the latter approach, the central routing computer is accessed to determine the recipient unit(s) and the data is then routed accordingly.

Referring particularly to FIG. 1, the data string is received by transmitter/receiver 20 and decoded by a decoder 22 in a manner similar to the encoding, i.e., direct with each message resulting in a single activation, or sequenced with a data string decoded into a timed succession of activations. The encoder and decoder hardware in each bracelet, although shown separately in FIG. 1, are preferably designed as one integrated logic set which performs the described functions.

Delivery of the squeeze on the recipient bracelet 12 is made via mechanical control 24 to transduce a physical, tactile sensation. The nature of the signal could be a tap (by a solenoid/plunger configuration or other conventional electromechanical device) or a vibration. The most desirable signal, however, would be a contraction of the bracelet itself, thus reciprocating the squeeze which initiated the message. A contraction mechanism could be implemented through the use of conventional solenoid or other electromechanical actuator. Alternatively, nitinol or other shape memory alloy (SMA) material can be used in conjunction with mechanical leverage to produce the necessary stroke. SMAs have been used to produce a variety of actuators (see e.g., U.S. Pat. No. 5,463,514), including pneumatic valves (e.g., U.S. Pat. No. 5,494,113), active temperature sensors (e.g., U.S. Pat. No. 5,483,309), and latching mechanisms.

The system of the present invention can utilize a system in which the change in the state on one device affects the states of the other devices, but not vice versa. Preferably, however, the devices are mated such that the two are substantially identical. Consequently, bracelet 12 would have a sensor 26 and encoder 28 substantially similar to sensor 14 and encoder 16; similarly, bracelet 10 would have a decoder 30 and mechanical control 32 that are substantially similar to the corresponding items in bracelet 12. Bracelet 10 would thus have a decoder 30 substantially similar to decoder 22 in bracelet 12 and mechanical control 32 substantially similar to mechanical control 24 in bracelet 12.

The physical movement of the receiving device can be a one-time contraction as described, or it can be a series of contractions until the recipient responds with a squeeze to that bracelet.

Figure 3:
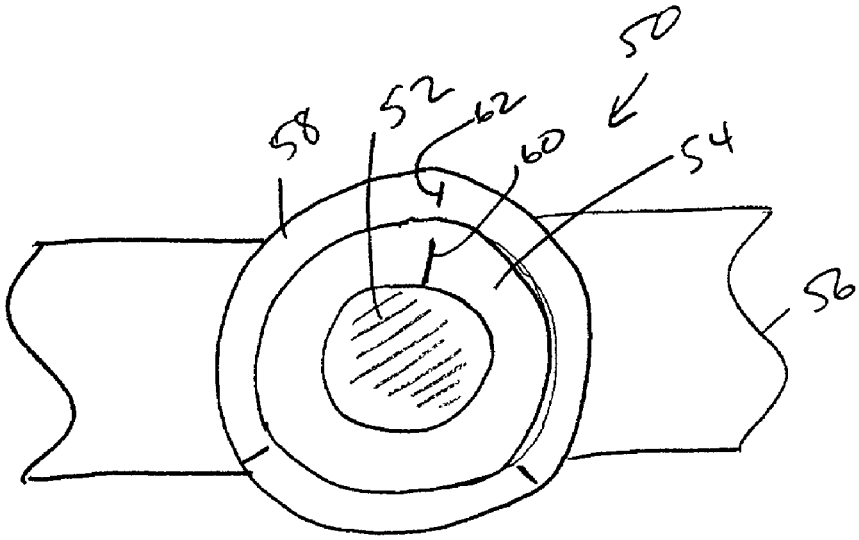
FIG. 3 is a pictonal view of a device according to another embodiment.

Many variations on the squeeze bracelet system of FIG. 1 are possible by substituting different types of sensors and controls. Referring also to FIG. 3, in another embodiment, a bracelet 10 based on the state of a color (or other visual cue, such as a pattern) is used to allow two wearers to share a message by selecting one of several different colors on the device. The operation of color bracelet 50 makes use of a two-way wireless system very similar to the squeeze bracelet. Color bracelet 50 may resemble a watch with band 56, a colored face 52 as the notification mechanism, a rotating bezel 54 as the activation mechanism, and an outer ring 58. A wearer activates color bracelet 50 by rotating the bezel 54 to line up mark 60 on bezel 54 and mark 62 on ring 58, which changes the color of the face 52.

In a manner similar to the devices shown in FIG. 1, a sensor detects, encodes, and transmits a signal indicating the rotation, resulting position and/or color. Shortly thereafter, the mated color bracelet receives and decodes the message and changes the color of its face to match the color of bracelet 50. In essence, the states (i.e., colors) of the two devices, are synchronized using wireless technology so that both color bracelets of a mated pair always share the same color. The color bracelet may thus convey the idea of always being connected, as if by sharing a mood.

The color bracelet may be worn like a watch (pocket or wrist), which may in fact keep time as well. The color bracelet is nominally in "standby mode" during which time the colors are preferably the same. Rotating the bezel with several discrete click stops activates the bracelet. In one embodiment, moving one click causes the color of the watch face to rotate one step through a cycle of choices (e.g., red, blue, green, yellow) and initiate a transmission to the mated bracelet so that its color can be synchronized. Consequently, while the receiving bracelet can physically rotate its bezel, it may only be necessary to transmit the resulting color to cause the color of the other bracelet to change, while the bezel is a mechanism for stepping through the possible colors on the device that is being changed. The physical state of the coloring mechanism, however, would thus be changed in a persistent manner, and optionally in a temporary manner.

Encoding color (state) information is performed by direct mechanical encoding. For example, the state of several binary switches which are affected by the rotation of the bezel, the position of the background, and/or any other mechanism related to the face color are encoded. The color may be represented by a number (e.g., 0, 1, 2, and 3) and combined with other information required by the communications protocol (e.g., unit identification number, recipient ID number, error bits, and data length) to become the full transmission data packet. Thus, the color portion may only require 2 bits in this case.

For decoding, the message received by the bracelet indicates the new desired color and is directly converted via simple logic into electrical and/or electromechanical actions which change the color of the bracelet. Color changes of the watch face may be achieved by a variety of methods, including energizing one of several LEDs or mechanically rotating a partially-exposed, multi-colored background.

In an embodiment related to the color bracelet, the color may change in response to a passive physical input, such as a change in body temperature of the wearer. This bracelet can thus be similar in this respect to a "mood ring" which changes color; unlike a mood ring, however, the color change can be transmitted to cause a corresponding change in another device, preferably on a temporary basis to allow the receiving device to transmit back a change.

While this embodiment has been described in terms of color, a face on a device can have a small number of patterns that can be used. In this case, the users of the devices may have an unwritten code associating certain patterns with certain messages between the users. Adjusting the device to show a pattern causes a corresponding pattern to appear in another device. These patterns can be a heart, a spiral, or even abstract shapes that may or may not have additional connotations (as a heart would).

In another embodiment, the system of the present invention can be used for emergency purposes. When an accident or crime happens, there may not be the opportunity to find a pay phone or even access one's cellular phone. With a simple, but intentional, squeeze, the emergency bracelet not only alerts authorities that trouble is happening but where assistance is needed. The ease and accessibility of the emergency bracelet allow the user to call for help even in front of assailants.

The emergency bracelet has the same range of design possibilities as the basic bracelet. A particular model, for example, may be designated for the elderly, where a squeeze automatically dispatches medical attention as well as notifies a designated family member who wears a mated unit. Unlike existing wireless emergency notification devices which are essentially tethered to within a fixed range of the base unit, the emergency bracelet system utilizes wireless networks and advanced location determination technology to provide safety anywhere.

The components of the emergency bracelet may be substantially similar to the bracelet described in conjunction with FIGS. 1 and 2. Current pager and cellular phone technology have built-in unit location capability to within a city block and requires no additional hardware for the mobile unit; triangulation is performed by the network hardware, and the location is available to be passed to the appropriate destination via any electronic means.

As a squeezable bracelet may be squeezed several times in succession, a double squeeze, for example, may be differentiated from a single squeeze (e.g., a double squeeze may transmit a "cancel emergency" or "accidental activation" code) and require data encoding. The process of encoding is identical to the basic bracelet. Transmissions from emergency bracelets would contain a flag identifying the data packet as a distress signal or even a particular type of distress signal.

The receiving station and associated network is one in which mobile unit location is a built-in feature, such as a pager system. Once received by the wireless network, the transmission is identified as a distress signal by its content, which automatically initiates triangulation of the transmitting unit's location. This information is then forwarded to the agency that handles the emergency and then waits for authorization from the agency notified to transmit a signal to reset the activated emergency bracelet. If a mated unit is involved, the network notifies this unit, and thus a signal can be provided to both emergency service and to a mated unit with a relative.

To facilitate location determination to resolutions better than that possible by the wireless network, the mobile unit may send out an RF homing signal. Authorities responding to the emergency would be equipped with a device tuned to this homing signal.

Emergency bracelets which have been activated may be reset remotely (e.g., by transmitting a reset code to the unit from the central system) or locally by the authorities responding to the emergency or by the user.

In scenarios where parties are typically physically close to each other, the use of a wireless network to route signals may be unnecessary. In this case, a simpler version of the devices bypasses a wireless network and transmits signals to any mated devices directly. Such local devices must be reasonably proximate, such as within a few hundred meters, such as a school, office building house, or shopping mall, or even a mile or two. The system is thus similar to that shown in FIG. 2, with the lines identified as 3*a*, 4, and 5 being replaced by a direct connection.

The operation of these devices, referred to here as a "local bracelet," is essentially identical to that described above except for the use of direct RF transmission and reception. Unit identification may still be rigorous if necessary (each unit is assigned a unique ID number). Matings are stored on board each unit since there is no longer a central routing system. Since the complexity of the network and the rigidity of its protocol has been removed, transmission between two local bracelets may readily be tailored for the specific application.

The local bracelet represents an entire category of novelty items which use RF transmission and reception to affect mated units. Another variation, a "local proximity bracelet", displays signal strength of its mates via a series of LEDs, much like radar detectors, and may be used to locate a mated unit, so as to meet up with a person or for hide-and-seek-type games such as skirmish or nighttime capture the flag. Alternatively, each bracelet can have a pointer, for example, resembling a compass needle, to point to the other bracelet. In that case, the bracelets can frequently send signals back and forth.

Each unit is mated with another in a way such that a given member of the group is seemingly aware of the states of the others at all times. This action is accomplished by sensors and/or actuators located within each unit which then trigger a communications sequence utilizing wireless signaling to pass a new state of the unit (encoded in a form which conforms to the protocol used by the carrier) to groupmates. The technology to do so may be accomplished locally (i.e., within shouting distance) using direct RF transmission and reception, or with unlimited range using any type of existing wireless networks (such as pager and cellular phone).

Two-way messaging devices are well-suited for receiving and replying to incoming messages. All outbound messages are directed to the central system of the service provider. With the aid of an external device such as a computer, data instructing the central system to redirect the message to another two-way pager may be included with the transmitted message. A method for linking two units based on two-way messaging technology is to "hard-code" this routing information on board each unit (e.g., in ROM, or better still, EPROM's, which allow easy reprogramming if the unit is to be remated with a different unit). Upon receiving the transmission, a local base station has all of the information necessary to automatically relay the message to the appropriate tower for retransmission to the mated unit.

A second method is to link the units via software such that each transmission is routed to a central database which contains the identification number of its mate. While this process may introduce delays associated with accessing a lookup table, system management is simplified (i.e., all transmissions necessarily pass through the central system and may be logged for market research and error tracking/auditing purposes, and features such as unit pair remating become trivial). In both cases, the central system becomes transparent to the user and all of the circuitry within each pager associated with its ability to interface and communicate with an external device may then be eliminated, making the unit smaller and lighter and therefore more easily embedded within products designed to be worn. A benefit of using two-way messaging networks is the fact that error handling and message receipt are built-in features of the communication protocol. A central system of a cellular network is inherently transparent to the user since all messages are automatically routed to a specific recipient designated by the phone number entered by the user.

Range limiting may be accomplished in a number of ways, depending upon a desired maximum distance of operation. Pager service providers, for example, already offer different levels of service ranging from nationwide to local city-side coverage. The range of operation may also be customized by setting up dedicated relaying towers in desired areas. For very short-range operation, a unit can be configured to bypass the network altogether by transmitting a data packet similar to that of the relaying tower (if the unit itself has the information necessary to do so). This method ensures the specificity of the recipient while limiting the range to distances determined by the power of the transmission and the sensitivity of the receiver.

Because the communications hardware is embedded within the unit, the fact that wireless transmission and reception is occurring is essentially a transparent aspect of the device. Because the information passed between two units is not manually composed by the user, the use of microphones, speakers, or general purpose displays and keypads (i.e., alphanumeric or other complex input and readout display) are not necessary. Instead, a change in state automatically initiates a transmission and therefore may be realized using simple and direct physical mechanisms, such as the press of a button or the turn of a watch bezel. The mere fact of the arrival of a message is, in most cases, inseparable from the message.

Because of the simple interface, the units can be designed to be worn rather than carried. That is, units may be designed as a fashion accessory, much like a wrist watch or other jewelry, rather than a distinct utilitarian device, such as a pager or cellular phone. This design contrasts with other devices that require fairly cumbersome, as well as unsightly, keypads and alphanumeric displays to send and receive messages. Additionally, the simplicity lends itself well to being combined with such utilitarian devices, such as a watch. For the same reason, units can readily be made tolerant of a variety of environments, such as extreme temperature, high altitude, immersion, and shock.

The bracelets thus allow two or more people to stay in touch regardless of how far apart they are from one another. While some may use the bracelet for decidedly practical purposes, others may find it to be the perfect pastime. In the hands of teenagers, for example, "secret messages" could be passed between two friends by a series of squeezes comparable to Morse code. Including bracelets in schoolyard games, such as tag or kick the can, not only changes the dynamics of the activity but adds another dimension to teammate cooperation. Local bracelets directed at the youth market may thus become centerpieces of their own games.

Having provided a number of embodiments to the present invention, it should be apparent that modifications can be made without departing from the scope of the present invention as defined by the appended claims. For example, while the state adaptation devices have been described in terms of bracelets and wristbands, the principle can be provided, for example, by a pendant or a necklace, or other items.

What is claimed is:

1. A communications system comprising:

a first device including:

a sensor for sensing a change in a physical state, and a transmitter for transmitting a signal indicative of the change in state;

a second device including:

a receiver responsive to receiving a signal indicative of a change in physical state of the first device, and a mechanism for changing the state of the second device in a manner that is substantially similar to the change in the state of the first device;

wherein the change in a physical state includes a change in the outward appearance of at least a part of the first device or a movement that causes a change in the position of one part of the first device relative to other parts of the first device.

2. The system of claim 1, wherein the change in state includes a squeezing contraction on the first device, and the mechanism in the second device causes a contraction in the second device.

3. The system of claim 1, wherein the change in state includes a color change, such that a portion of the first device changes color and the mechanism in the second device causes a change in color to a corresponding part of the second device.

4. The system of claim 1, wherein the second device stays in the changed state until either the first device or second device is changed to change that state.

5. The system of claim 1, wherein the change in the second device is temporary and the state changes again after a predetermined time.

6. The system of claim 1, wherein the transmitter transmits to the second device via a wireless network.

7. The system of claim 1, wherein the transmitter transmits directly to the second device.

8. The system of claim 1, wherein the change in state caused in the second device is non-textual and inaudible.

9. The system of claim 1, wherein the first and second devices are bracelets and the change in physical state sensed by the first sensor and caused in the second device is a physical contraction of the bracelet.

10. The system of claim 9, wherein the second device includes a shape memory alloy that can contract.

11. The system of claim 1, wherein the first and second device each have a viewable face and a movable part causing one of a number of patterns to appear on the face of the first device, wherein the mechanism changes a face on the second device to be the same as the pattern on the face of the first device.

12. The system of claim 1, wherein the devices are mated such that the signal is transmitted from the first device goes to the second device and not to other devices of a similar or different type.

13. The system of claim 1, wherein the first device is in the form of a bracelet.

14. The system of claim 13, wherein the bracelet has no user controllable buttons or other devices except the ability to be squeezed.

15. The system of claim 14, wherein the second device is also in the form of a bracelet.

16. The system of claim 1, wherein the second device has a sensor and transmitter substantially similar to those in the first device, and the first device has a receiver and mechanism substantially similar to those in the second device, such that the second device can transmit to the first device a signal indicative of a change in the physical state of the second device.

17. The system of claim 1, wherein the second device does not have a sensor and transmitter, and thus the transmission of a signal indicative of a change in physical state can only go one way from the first device to the second device.

18. A communications system comprising a first device in the form of a wearable bracelet including a sensor for sensing a squeezed contraction to the bracelet that causes the bracelet to contract around and squeeze the wearer of the bracelet, and a transmitter for transmitting a signal indicative of the contraction.

19. The system of claim 18, further comprising a second device including a receiver responsive to receiving the signal indicative of the contraction and providing an indication of the contraction.

20. The system of claim 19, wherein the second device contracts in response to received of the signal.

21. The system of claim 20, wherein the second device includes a shape metal alloy.

22. The system of claim 19, wherein the transmitter transmits to the receiver via a wireless network.

23. The system of claim 19, wherein the transmitter transmits to the receiver directly.

24. The system of claim 18, wherein the bracelet has a plain appearance with no user-operable input devices other than the ability to be squeezed.

25. A method comprising:

a first device sensing a change in a physical state of the first device, the first device transmitting a signal indicative of the change in the physical state of the first device;

a second device receiving the signal indicative of the change in physical state of the first device; and the second device changing its state in a manner substantially similar to the change in first device;

wherein the change in a physical state includes a change in the outward appearance of at least a part of the first device or a movement that causes a change in the position of one part of the first device relative to other parts of the first device.

26. The method of claim 25, wherein the first device includes a wearable bracelet and the change sensed by the first device is a physical contraction that causes the bracelet to contract around the wearer of the bracelet.

27. The method of claim 26, wherein the second device includes a bracelet that contracts to squeeze the wearer in response to receiving the signal.

28. The method of claim 25, wherein the first device senses an actuation that causes a change in a visible image that appears on the first device and sends a signal indicative of this change.

29. The method of claim 28, wherein the second device changes so that the visible image appears on the second device.

30. The method of claim 25, wherein the change in the second device is temporary and the state changes again after a predetermined time.

31. The method of claim 25, wherein the first device transmits to the second device via a wireless network.

32. The method of claim 25, wherein the first device transmits directly to the second device.

33. The method of claim 25, wherein the change in state caused in the second device is non-textual and inaudible.

34. The method of claim 25, wherein the first and second device each have a viewable face and a movable part causing one of a number of patterns to appear on the face of the first device, wherein the first device transmits a signal indicative of a change in the pattern that appears on the face to cause the same pattern to appear on the face of the second device.

35. The method of claim 34, wherein the patterns are colors on the face of the devices.

* * * * *